United States Patent [19]

Granskog

[11] Patent Number: 5,007,683

[45] Date of Patent: Apr. 16, 1991

[54] METHOD AND EQUIPMENT FOR NARROW ORE MINING

[75] Inventor: Roland Granskog, Skelleftea, Sweden

[73] Assignee: ALIMAK AB, Sweden

[21] Appl. No.: 382,705

[22] PCT Filed: Jan. 22, 1988

[86] PCT No.: PCT/SE88/00023

§ 371 Date: Aug. 14, 1989

§ 102(e) Date: Aug. 14, 1989

[87] PCT Pub. No.: WO88/06225

PCT Pub. Date: Aug. 25, 1988

[30] Foreign Application Priority Data

Feb. 19, 1987 [SE] Sweden ..... 8700687

[51] Int. Cl.[5] ..... E21C 35/16; E21C 41/00; B66B 17/04

[52] U.S. Cl. ..... 299/10; 175/219; 299/19

[58] Field of Search ..... 299/10, 15, 18, 12, 299/19; 125/61, 213, 219, 91

[56] References Cited

U.S. PATENT DOCUMENTS

| | | | |
|---|---|---|---|
| 3,068,654 | 12/1962 | Warren | 299/10 X |
| 3,731,976 | 5/1973 | Granskog et al. | 299/18 |
| 4,053,182 | 10/1977 | Nelson | 299/19 |
| 4,132,276 | 1/1979 | Svenson | 299/10 X |
| 4,254,994 | 3/1981 | McBride | 299/12 |

FOREIGN PATENT DOCUMENTS

| | | | |
|---|---|---|---|
| 0756017 | 8/1980 | U.S.S.R. | 175/219 |
| 0777222 | 12/1980 | U.S.S.R. | 175/219 |

*Primary Examiner*—Ramon S. Britts
*Assistant Examiner*—David J. Bagnell
*Attorney, Agent, or Firm*—Townsend and Townsend

[57] ABSTRACT

For narrow ore mining, shrinkage stopping is used with working equipment, such as a working platform or mining rig (30), which is suspended in guide sections (38) in the roof of the mining chamber, and from which drilling and charging is carried through, the mining chamber communicating with a raise. In the raise, which follows the inclination of the ore body, a transport lift is used designed for receiving the working platform or mining rig (30) in its lift cage (20). The lift cage (20) comprises a transport guide arranged for suspension of the working platform or the mining rig in the lift cage and connectable to a start guide in the roof of the mining chamber.

14 Claims, 10 Drawing Sheets

METHOD AND EQUIPMENT FOR NARROW ORE MINING

Figure 1:
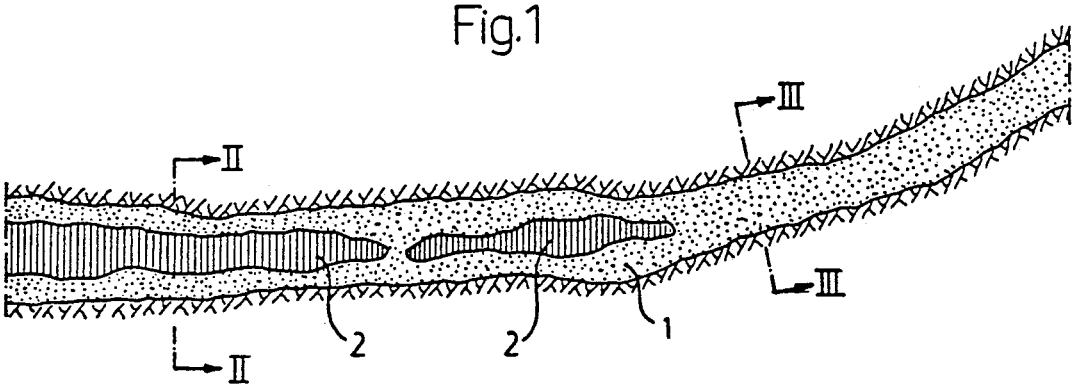

The present invention relates to a method and an equipment for using, in connection with narrow ore mining, shrinkage stoping technique with a working equipment, such as a working platform or mining rig suspended on guide rail sections in the roof of the mining chamber, from which working platform or mining rig drilling and charging is carried through, and which before blasting is moved into a raise leading to the mining chamber.

In several places in the world there are great ore deposits in the form of narrow ore bodies containing high grade ore. Due to the lack of economically acceptable techniqiue these ore deposits have hitherto been taken care of to a very small extent. The ore bodies referred to here have, by way of definition, a width of an order of magnitude of 4–5 meters at most, and they can have a great extension in the height and length directions. Furthermore, it has turned out that the planes of these thin ore bodies to a very great extent lean 45°–90° with respect to the horizontal, with a concentration tc the area 60°–70°.

In the Swedish patent 333,342 a mining method is described, which nowadays is usually called "mechanized shrinkage stoping", and which is used for broader ore bodies. Mining is carried through by means of a mining rig which is suspended on guides in the roof of the rock chamber, and from which drilling and charging is carried through. The guides being successively mounted in the roof of the rock chamber from the rig, continuously continue via a rounded off transition into a raise into which the mining rig is driven before blasting. Mining with horizontal drilling is carried through successively from the raise to the end of the rock chamber located at most remote from the raise. After finished horizontal mining, mining with vertical or close to vertical drilling is started from this end back toward to the raise.

The method just described has the great advantage as compared with conventional shrinkage stoping that the loosened ore need not be used as a platform for mining equipment and personal. Thereby the economical gain is considerably increased since removal of the ore is not dependent from the ore excavation.

The object of the present invention is to provide a method and equipment, by means of which mining of narrow ores becomes technically and economically practicable.

The invention is based upon the realization that the following principles shall be followed in order to attain this object:

1. The work shall be carried through from main levels, i.e. the narrow ore body shall not, as higherto, be reached via an intermediate drift system, the installation of which requires considerable amount in investment.
2. The mining and the removable of the loosened ore heap shall be possible to be carried through simultaneously and in independent operation.
3. Exploration drilling which is conventionally very expensive and can take a time period of a total of 6–7 years, shall be limited only to concern mainly determination of principally the approximate limits and extensions of the ore body. Instead the mining equipment shall be so designed and adapted that it enables that the ore body is followed mainly independently of its mainly unknown variation with respect to thickness, inclinations, windings and possible faults.

According to one aspect of the invention a method is used, that resembles the above described mechanized shrinkage stopping technique and thereby provides the advantages connected therewith. It should, however, be emphasized that said technique is based upon use of equipment that requires great space and shall be able to be driven on one and the same continuous guide system in the roof of the rock chamber and the raise. This known technique and equipment are completely unuseable when it is the question of narrow ore bodies with a width of 4 meters at most, the planes of which lean by an angle of an order of magnitude of 60°–70° to the horizontal, and which normally have many windings and possibly faults along their extensions.

By using, according to the invention, in the raise following the inclination of the ore body, a transport lift designed for receiving the working platform or mining rig in the lift cage, adaption of the size of the working platform or mining rig, intended to be suspended on guides in the roof of the rock chamber, to strongly changing conditions with respect to shape and dimensions in the ore body is made possible. Thus, in one case it may e.g. be necessary to carry through mining from a working platform having a width of one meter, form which drilling is carried through by maens of manual drilling tools, and which is manually driven forwardly along the guide. In another case it may be possible to use a broader mining rig with one or more drill booms, and which uses an air motor or electric motor for the propulsion thereof along the guide.

By arranging a guide supsension in the transport lift cage for the working platform or mining rig, this guide then being sidewardly and lengthwardly movable and connectable to a start guide in the roof on the rock chamber, a flexible transistion is obtained for moving the working platform or mining rig between the raise and the mining chamber. One and the same guide suspension can then be adapted for working platforms or mining rigs of different kinds.

At start of the mining the start guide is first provided in the mining chamber roof close to the raise. Preferably, the start guide has a blocking device for the working platform or mining rig suspended thereon, which automatically starts to operate if the platform or rig should come in on it, when the transport cage has not yet been moved down.

Furthermore, preferably air and water feeding lines are connected via the start guide to air and water conduits for the mining equipment extending in a conventional way in the guide sections.

The guide sections are provided in the roof of the mining chamber so that they essentially follow the windings of the ore body and bridge any faults, in order to bring the shape of the mining chamber to follow essentially the shap of the narrow ore body. For this purpose a set of short, angled joining members are included in the mining equipment and arranged to be provided between two guide sections in order to change their mutual angle sidewardly and/or heightwardly and/or shift them in parallel sidewardly when the shape and the ore body requires. For similar reasons the mining platform is preferably pivotally suspended on the guide.

To advantage the invention is used for mining in a chamber extending in the plane of the ore body and conforming to the shape thereof, and having a length of an order of magnitude of 50–200 meters and a height of 50 meters or more.

Further features, objects and advantages of the invention will appear from the following description with reference to the drawings of some embodiments.

Figure 2:
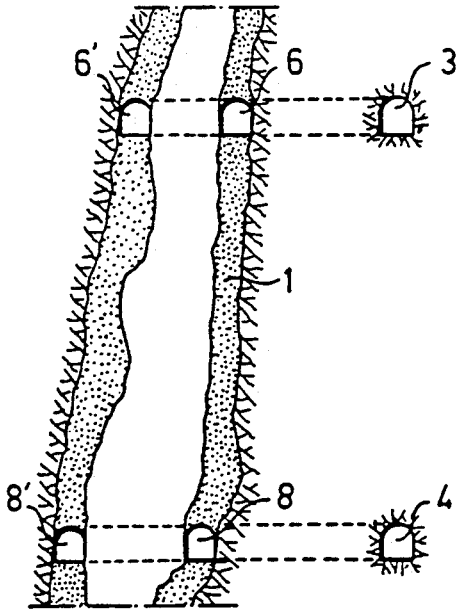
Figure 3:
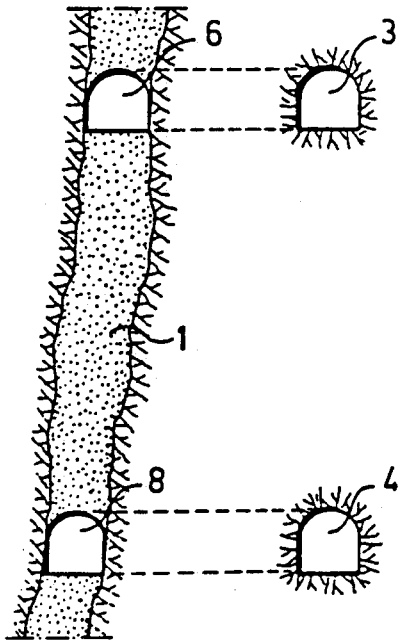
Figure 4:
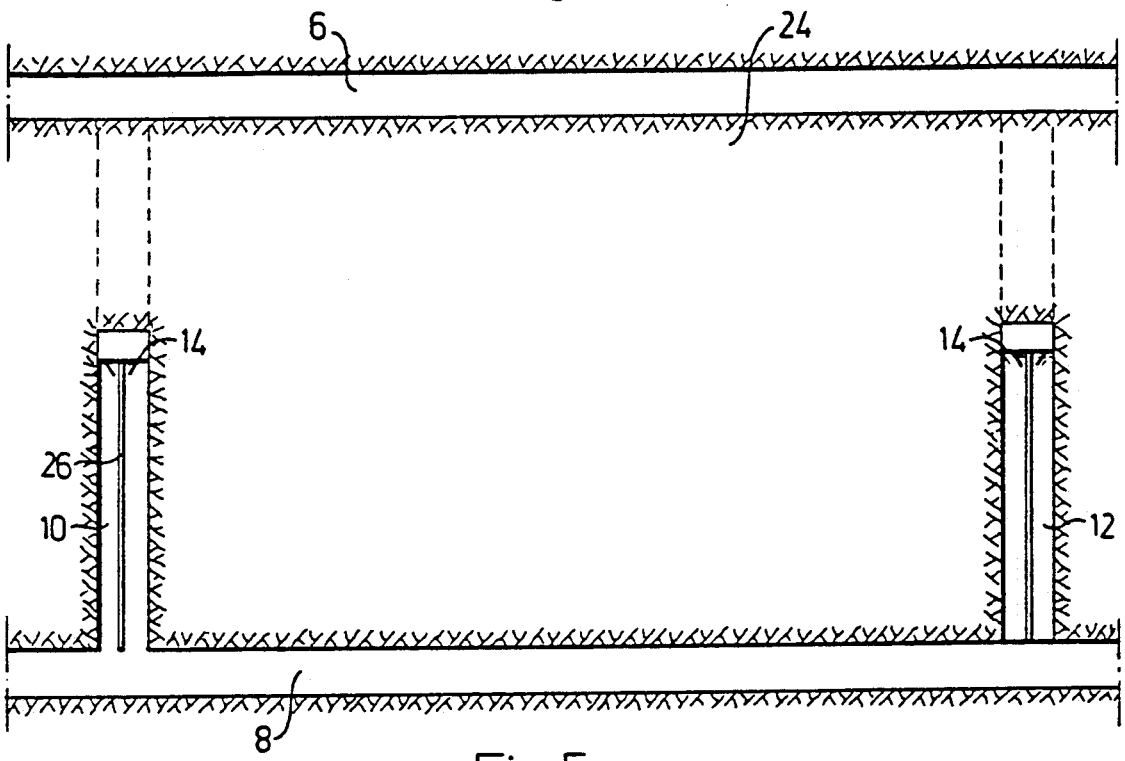
Figure 5:
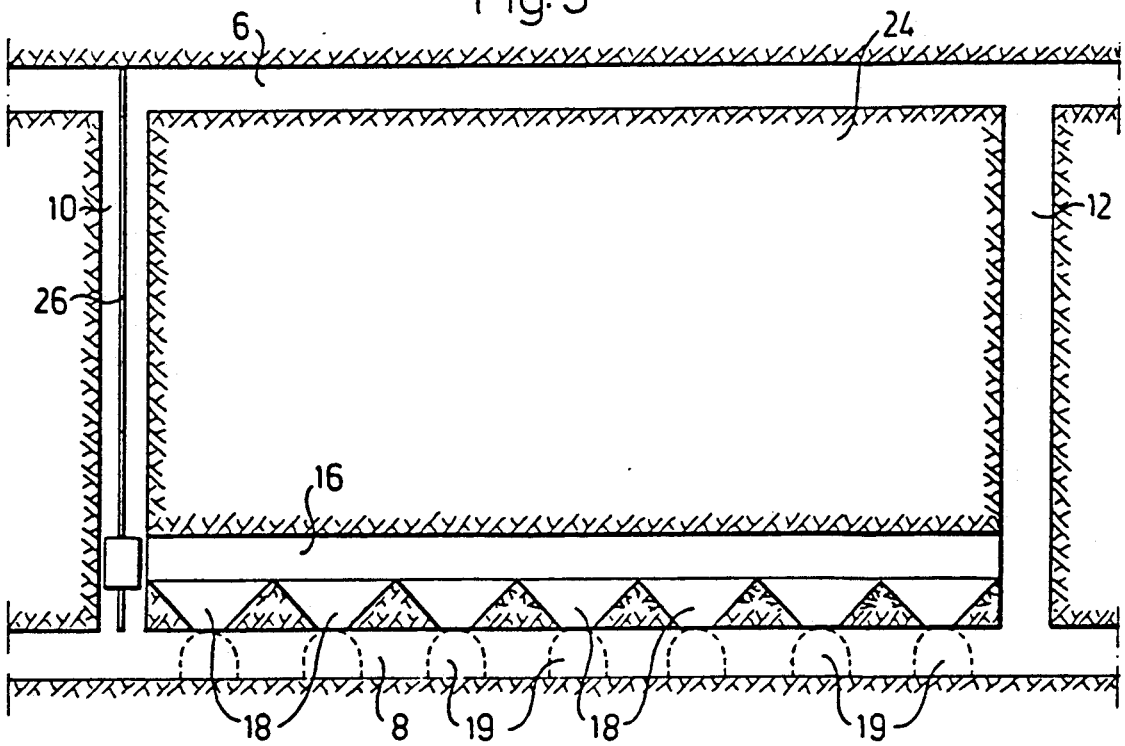
Figure 6:
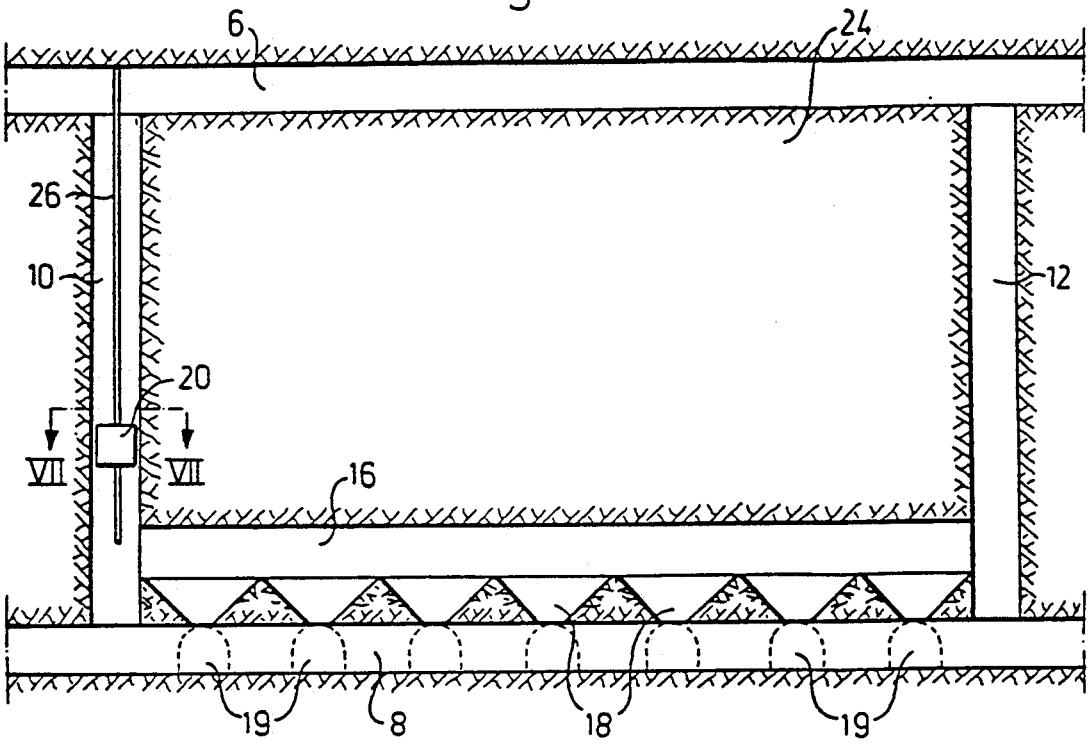
Figure 7:
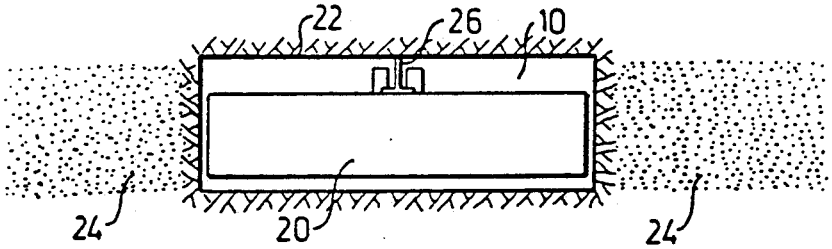
Figure 8A:
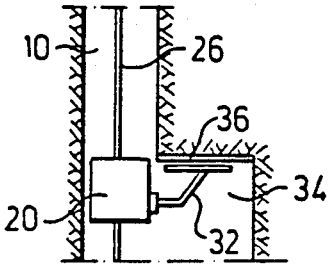
Figure 8:
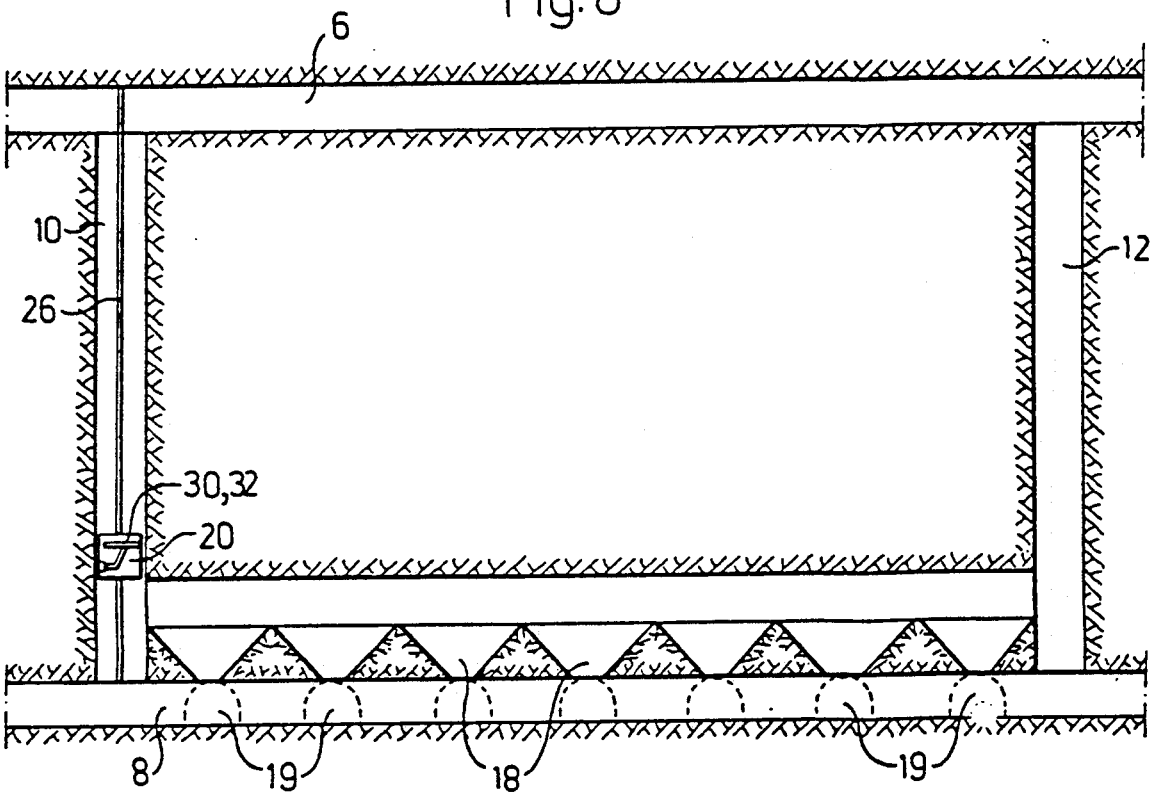
Figure 9:
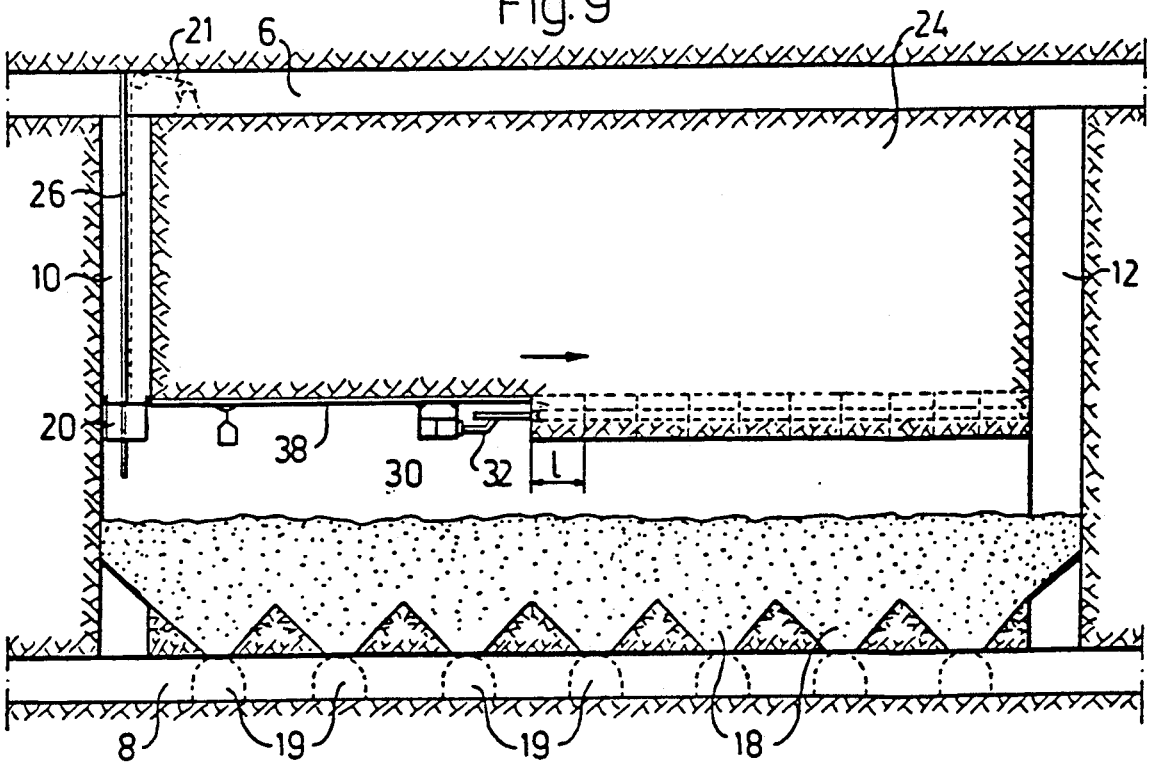
Figure 10:
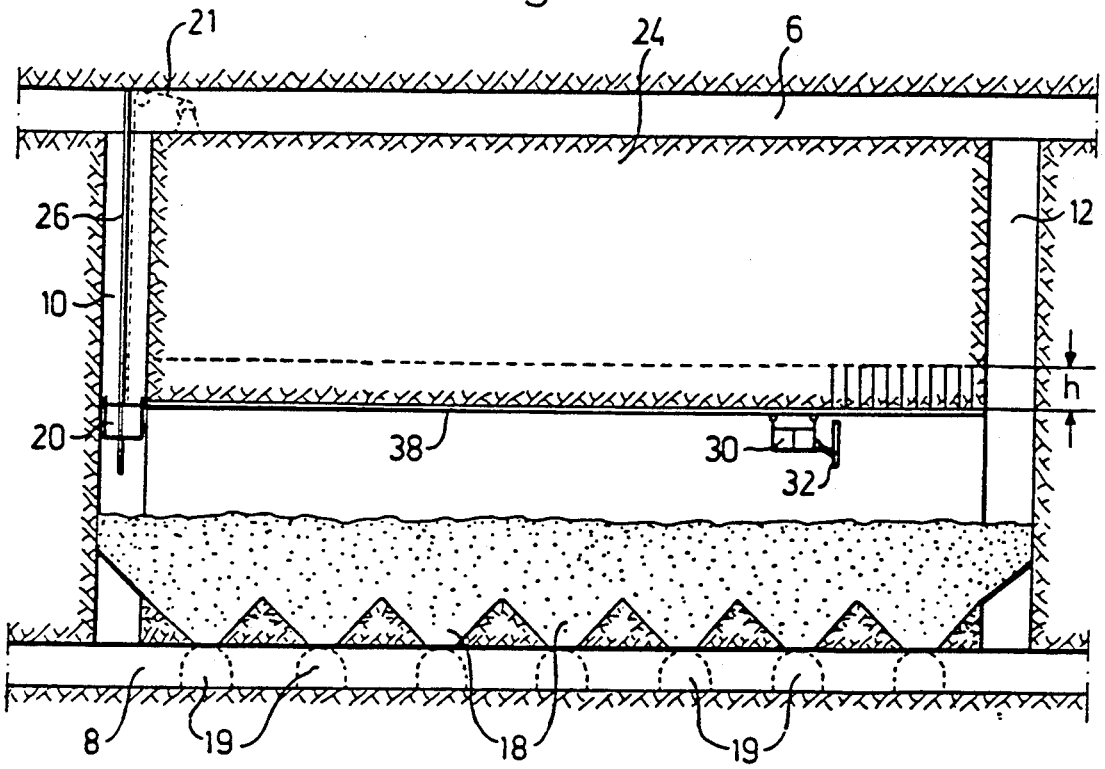
Figure 11:
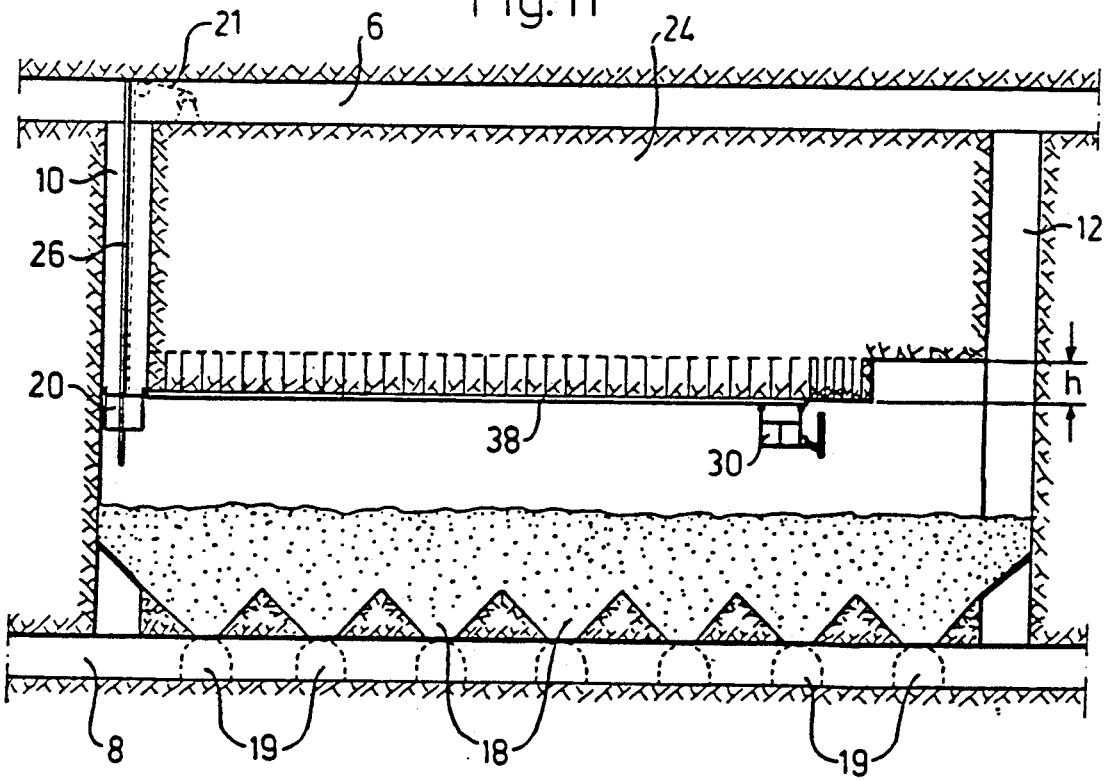
Figure 12:
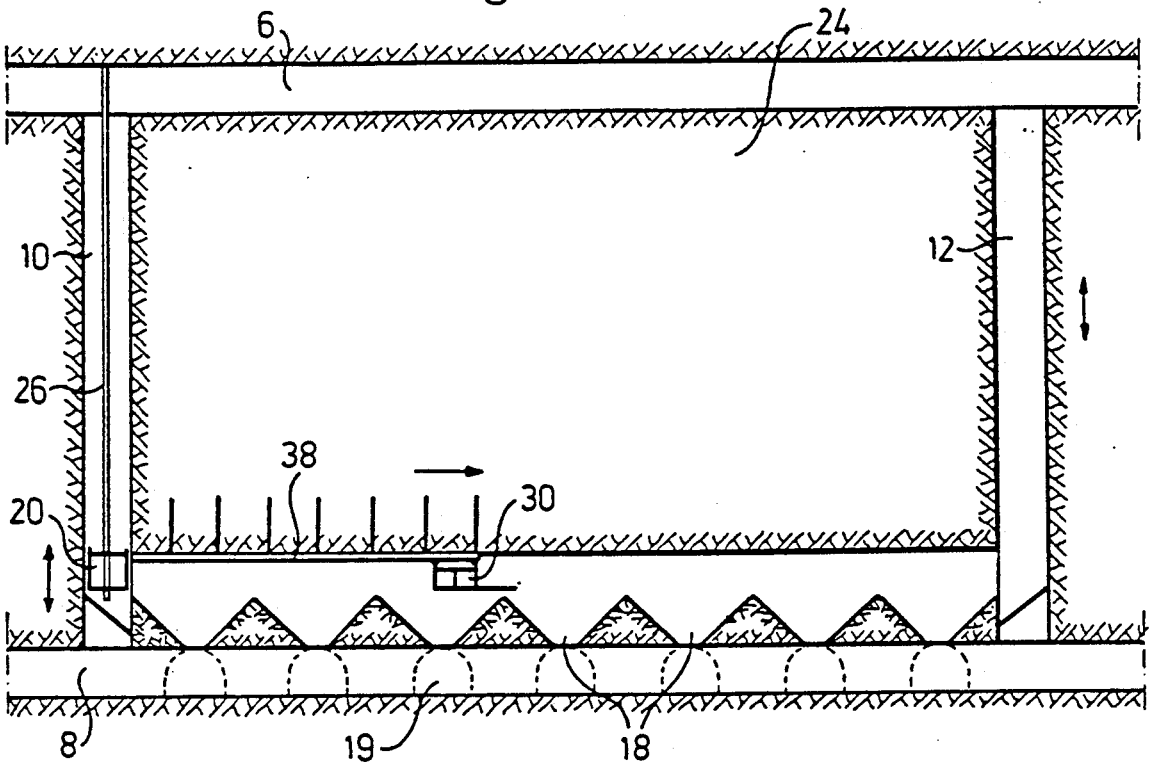
Figure 13:
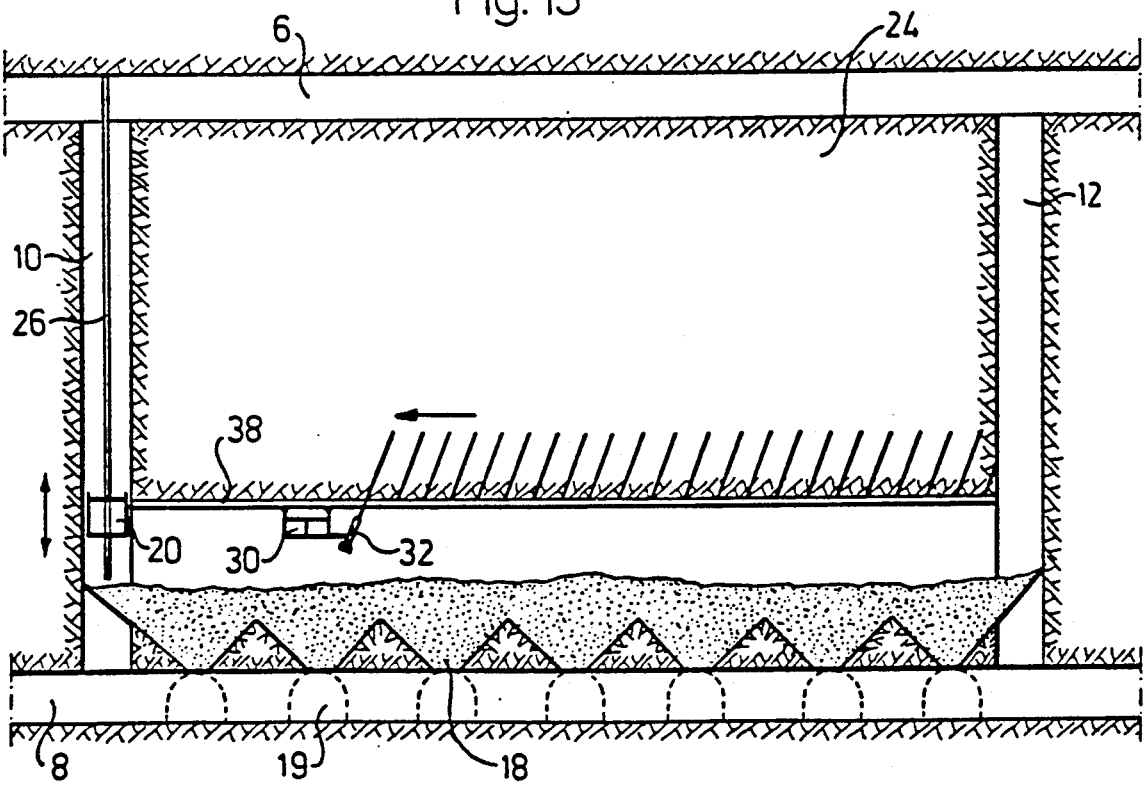
Figure 14:
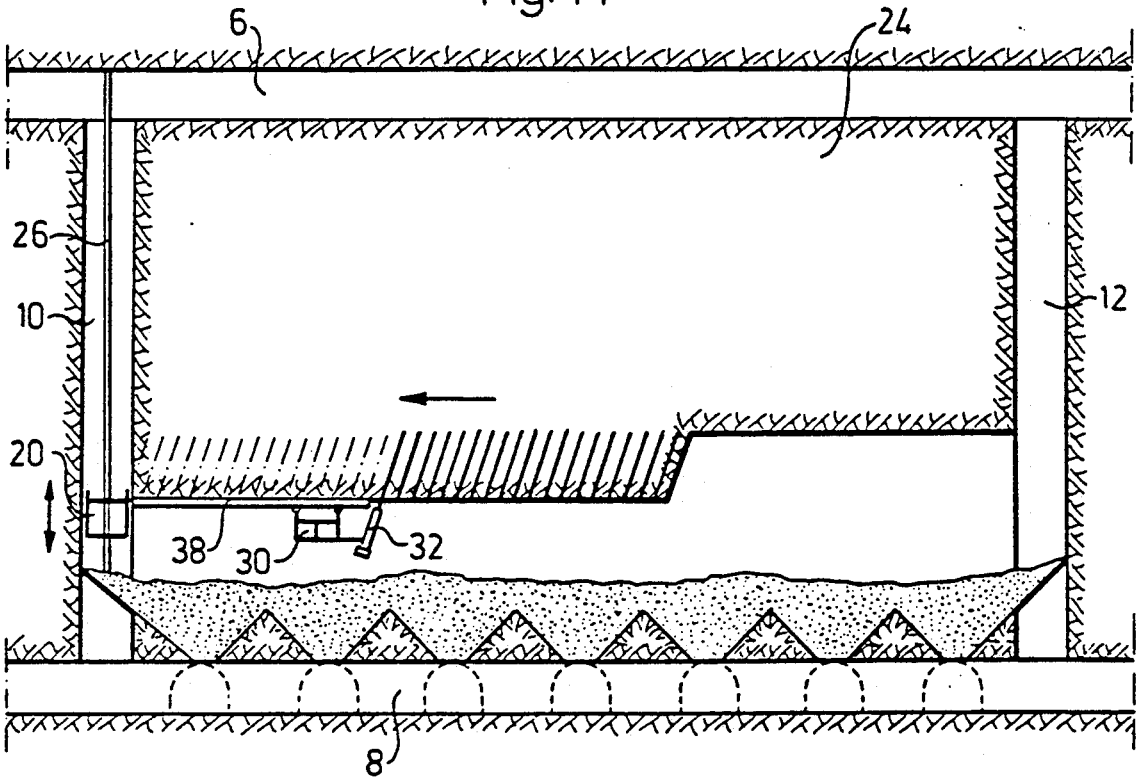
Figure 15:
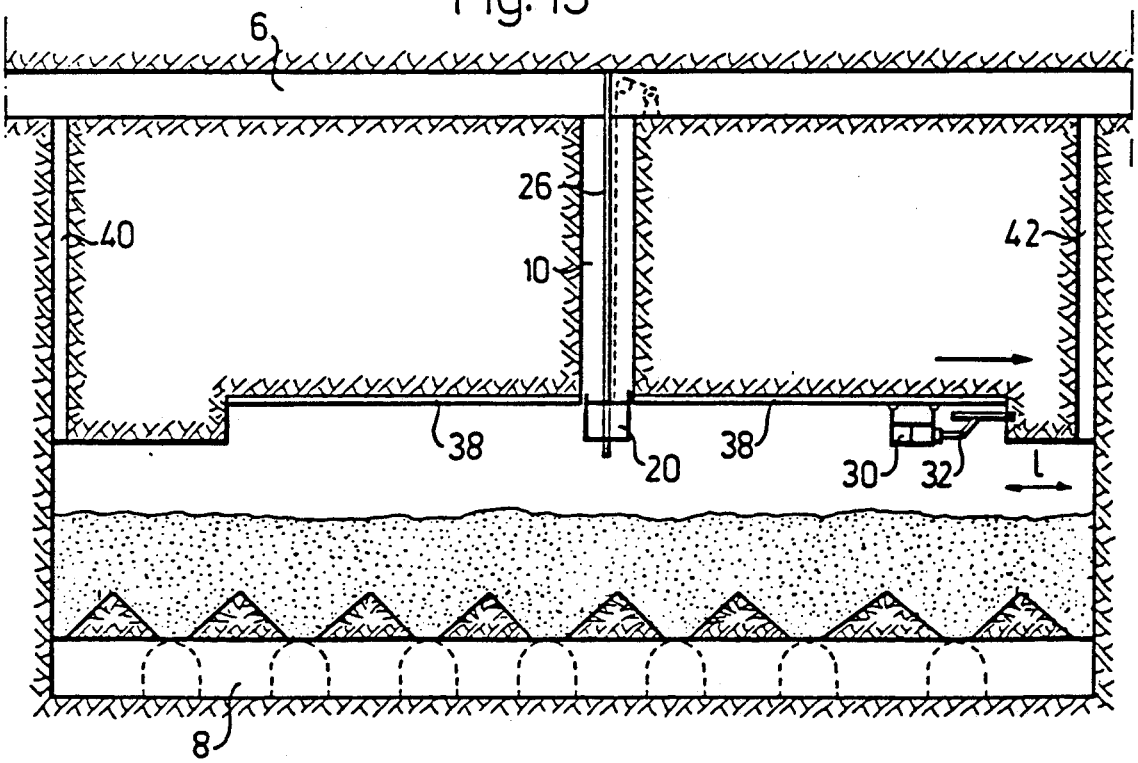
Figure 16:
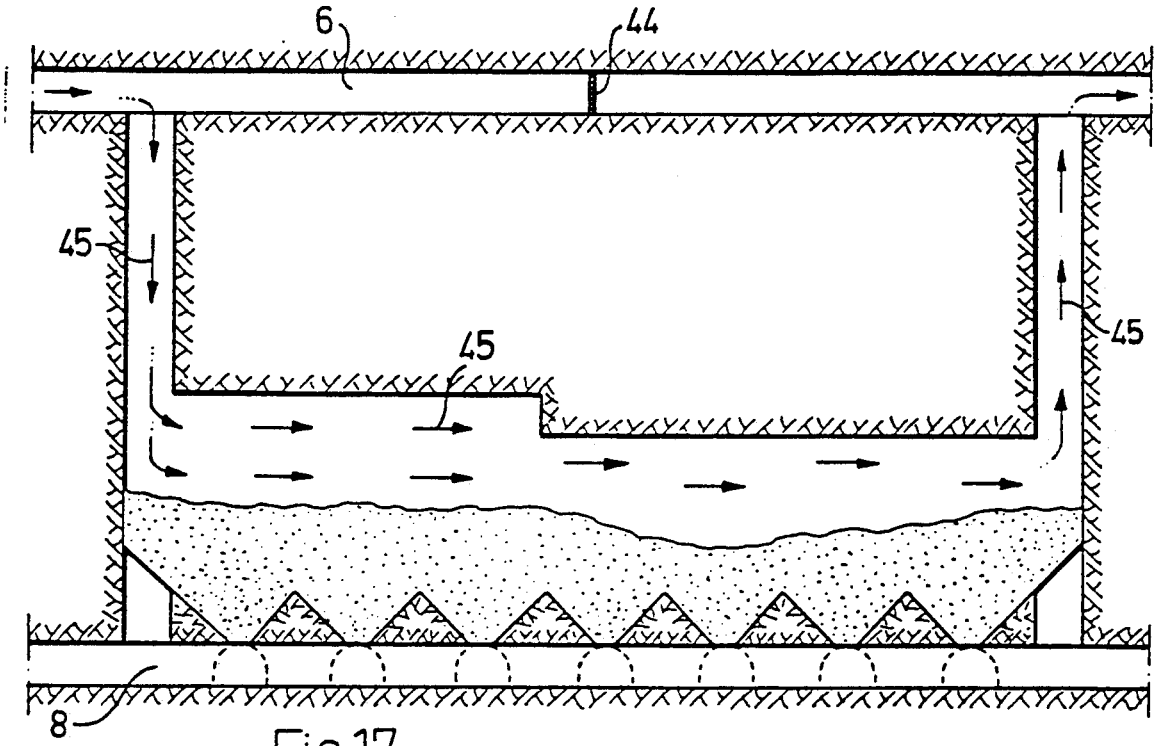
Figure 17:
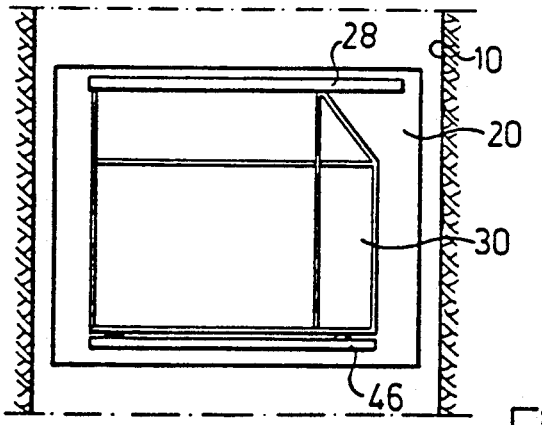
Figure 18:
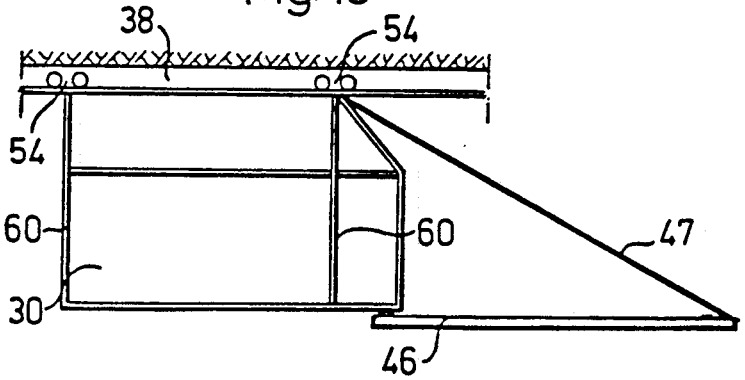
Figure 19:
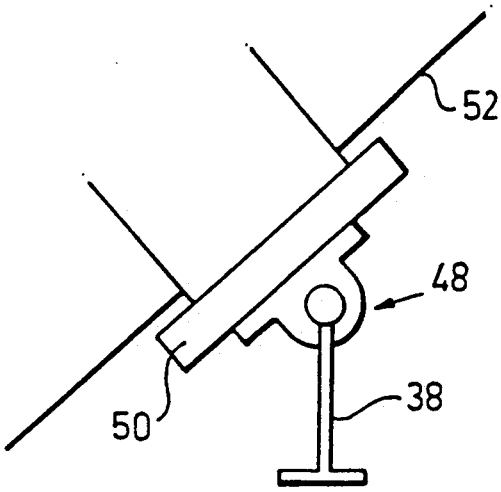
Figure 20:
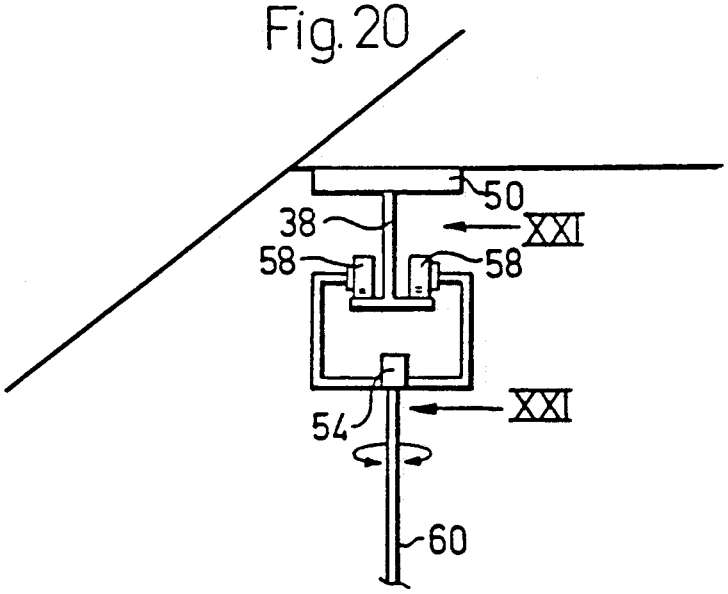
Figure 21:
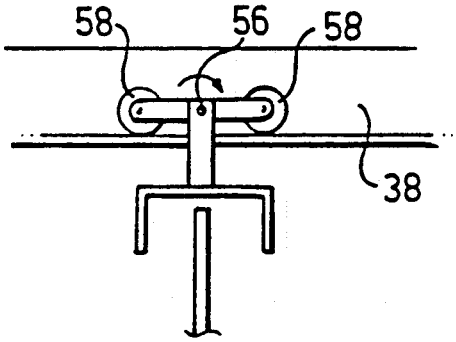

On the drawings:

FIG. 1 is a horizontal section through part of the extension of a narrow ore body, FIGS. 2 and 3 are vertical sections along a part of the extension of the ore body in the height direction and in the directions of arrows II—II and III—III, respectively, in FIG. 1, FIGS. 4–6 schematically, in sections along the plane of the ore body, illustrate three successive preparatory working steps at mining with the method according to the invention, FIG. 7 is a horizontal section in the direction of arrows VII—VII in FIG. 6, FIG. 8 in the form of view along the same plane as FIGS. 4–6 illustrates the starting step at mining according to a first embodiment of the method according to the invention, whereby FIG. 8*a* in a part view shows the next step, FIGS. 9–11 in similar sectional views as FIGS. 4–6 illustrate successive further operational steps in this first embodiment, FIGS. 12–14 in similar sectional views as earlier illustrate successive operational steps in a second embodiment of the method according to the invention, FIG. 15 in a similar sectional view as earlier schematically illustrates a third embodiment of the mining method according to the invention, FIG. 16 in a similar sectional view as earlier illustrates the principle of venting the mining chamber in the method according to the invention, FIG. 17 in an amplified schematical sectional view along the same plane as earlier schematically illustrates the principle for suspending a mining platform used with the method according to the invention in a transport lift cage extending in a raise, FIG. 18 in a similar way as FIG. 17 shows the mining platform suspended on guides in the roof of the mining chamber, FIGS. 19–21 in schematic part views illustrates the principle for pivotal attachment of guides and mining platform, respectively, in the method according to the invention, whereby FIG. 21 is a view in the direction of arrows XXI in FIG. 20, FIGS. 22*a–d* in schematic part views illustrate the use of joining elements between the guide sections.

In the different drawing Figures the same or similarly acting details have been provided with the same reference numerals.

FIGS 1–3 illustrate the extension and approximate appearance of a thin ore body 1. As appears the ore body can also contain interferring portions 2 of another mineral than the ore intended for mining. From transverse drifts leading to two main level drifts 3 and 4, respectively, two horizontal drifts 6 and 8, respectively, extending essentially in parallel with respect to each other, are driven in the ore body. At presence of said interfering portions it can also be suitable to drive further horizontal drifts 6' and 8', respectively.

From the lower drift 8 two raises 10 and 12, respectively, are driven in the ore body up to the upper drift 6. This step is illustrated in FIG. 4, where the work can be carried out with a conventional guide suspended raise lift 14.

In parallel with and above the lower drift 8 a horizontal so called cone drift 16 is dirven, the floor of which forms the lower wall of the rock chamber intended for mining. From the drift 8 a number of upwardly widening loading openings 18 are dirven to the cone drift 16. Although the drift 8 in the example shown is illustrated as extending in the ore body in the form of a so called transport dirft, it is usually preferred to locate the transport drift, then corresponding to the main level 4, sidewardly shifted with respect to the loading openings 18, with so called holding drifts leading into these. Such holding drifts are indicated by means of dashed lines at 19.

The provision of transport drift 8, cone dirft 16, loading openings 18 and holding drifts, if any, can be carried through in a way conventional in connection with shrinkage stoping.

Referring to FIG. 7 there is installed in the raise 10 a normally tooth or pin rack carried transport lift cage 20 filling up the rectangular drift section as much as possible. This transport lift cage can also be cable carried such as is indicated at 21 in some of the following Figures. The hanging side 22 of the drift section can extend outside the ore 24 and the guide 26 for the lift cage 20 is provided on this side.

Referring to FIG. 17, the lift cage 20 in the roof thereof carries a guide 28 for suspension of a mining unit, in the form of a working platform or mining rig 30 in the lift cage. The guide 28 is of the same type and profile as the guide sections intended to be used in the roof of the mining chamber in accordance with the following description. The guide 28, in a way not shown in detail, is mounted movable sidewardly and in its length direction in the roof of the lift cage. The mining unit 30 in one embodiment can be essentially only a working platform for drilling with manually operated smaller drill machines. This embodiment is particularly intended for very small thicknesses, down to approximately 1 meter, of the ore body. In another embodiment, intended for greater thicknesses of the ore body, a greater mining rig can have one or more drill booms 32 for mechanized drilling, indicated in FIGS. 9–15.

In a first embodiment of the method according to the invention illustrated in FIGS. 8–11, the mining is started, particularly referring to FIG. 8, with horizontal drilling from the working platform or mining rig located in the lift cage 20. After loading and blasting, during the latter of which the hoist cage 20 is driven upwardly into safety in the drift 10, a recess 34 is formed in the transition between the raise 10 and the roof of the mining chamber, with a length admitting installation of a first guide 36, here called start guide. After installation of this start guide 36 in the roof of the recess 34, the guide 28 movably mounted in the lift cage 20 is brought into line with this start guide 36 so that the working platform or mining rig can be moved out onto the the start guide according to FIG. 8*a*. Referring to FIG. 9, continued horizontal drilling is thereafter carried through with loading and blasting and stepwise lengthening with new guide sections 38, up to the raise 12.

In a second step vertical drilling is thereafter started from the raise 12 according to FIG. 10 with successive loading of the drill holes, demounting of the guide sections, and blasting, see FIG. 11. The newly blasted roof does not need to be scaled.

At smaller distances between blasting location and the drift 10 the working platform or mining rig can be moved, before each blasting, into the lift cage 20, which is driven upwardly in the raise 10. At greater distances it is enough if only the personnel is brought along upwardly in the raise 10.

After finishing of the vertical drilling mining step, the horizontal drilling discussed with respect to FIGS. 8 and 9 is started anew.

According to a second embodiment of the method according to the invention, and referring to FIGS 12–14 the horizontal drilling step is cancelled. Beginning from the lift cage 20, guide sections 38 are, instead, first mounted directly in the available roof of the mining chamber up to the raise 12, see FIG. 12. Thereupon vertical drilling is started from the auxiliary drift 12, see FIG. 13. Finally loading, successive disassembling of the guide sections and blasting is carried through in the same way as in the first embodiment see FIG. 14.

The second embodiment of the method according to the invention just described is well suitable for automation using drilling and loading robots.

FIG. 15 illustrates a modification of either one of the two described methods, that implies that the raise 10 is provided essentially centrally in the ore body 24 and a vent drift 40 and 42, respectively, is provided at each end of the ore body to be mined. Thereafter mining is carried through towards both directions from the lift cage 20 with either one of the two described methods.

FIG. 16 illustrates a very advantageous embodiment of the ventilation of the working site. In the drift 6 above the ore body 24 a closure 44 is provided so that fan driven vent air 45 is thus forced to flow past the worksite via the raise 10 and thereafter upwardly along the auxiliary raise 12.

In FIG. 18 some further details of a working platform 30 are shown. More particularly, the platform 30 carries on its underside a roller suspended lower lengthening deck 46, that can be brought to the protruded position shown and from a platform for scaling and attachment of new guide sections 38. At 47 support struts are indicated.

With reference to FIG. 19 there are means 48 for suspending at need, the guide sections 38 pivotally in their attachments 50. The pivoted suspension of the guides eliminates the need of a mounting surface extending esentially in the same horizontal plane along the ore body and admits attachment, e.g. in a hanging wall 52, instead of the roof of the narrow mining chamber, if this should be regarded as necessary, e.g. of strength reasons. Of course, the hanging wall can then also lean towards a direction opposite to that shown in FIG. 19.

With reference to FIGS. 20 and 21 the mining platform can be pivotally suspended both about a vertical pivot 54 and a horizontal pivot 56. In these FIGS. 58 designates support or drive wheels for the platform on the guides 38, and 60 is a suspension strut for the platform, see also FIG. 18. In FIGS. 20 and 21 and the guide 38 is rigidly attached with its attachment 50 in the horizontal roof of the mining chamber, contrary to the embodiment in FIG. 19. By the pivoted suspension of the mining platform, it can be flexibly adapted to the changes of direction of the mining chamber.

To enable adaption of the extension of the guide sections 38 to the sideward windings of the mining chamber and even bridge smaller faults, joining members 62 of the kind schematically illustrated in FIG. 22 can be used in arbitrary combinations for angling or shifting in parallel of the guide sections 38 with respect to each other. The width of such joining section 62 corresponds to the tooth or pin rack pitch of the guide sections, indicated by points 63 in such a way that said pitch is also maintained in the joint transitions. In order to eliminate risk of jamming for the pinions cooperating with the tooth or pin rack, the tooth or pin of the joining section 62 that extends in the drawing plane in FIG. 22*a–c*, should be bevelled, i.e. have clearances towards the ends.

In order to be able to pass a portion with non-interesting minerals, see 2 in FIG. 1, it can be desirable in certain cases to pass it on its upper or lower side. For this purpose it may be needed to change the direction of the guide sections upwardly and/or downwardly. Also here joining elements of a similar type as the joining elements 62 in FIG. 22*a–c*are then used. Introduction of such joining elements 64 is schematically illustrated in FIG. 22*d*.

Figure 22A:
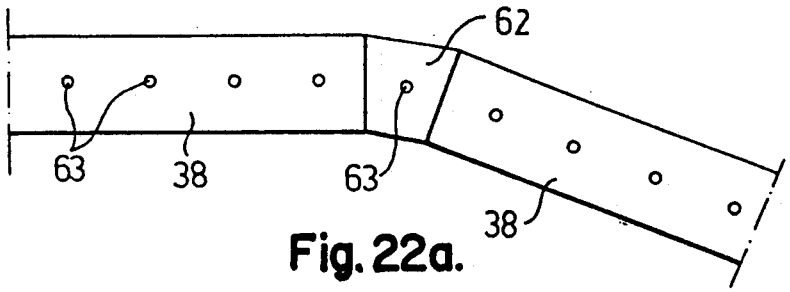
Figure 22B:
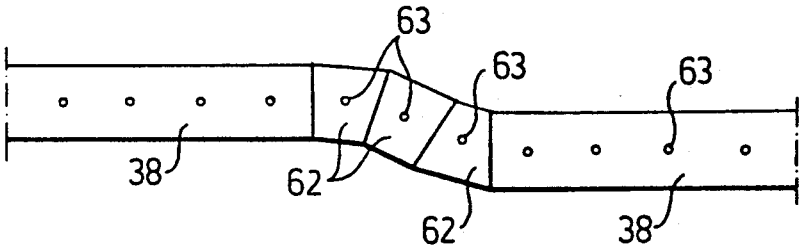
Figure 22C:
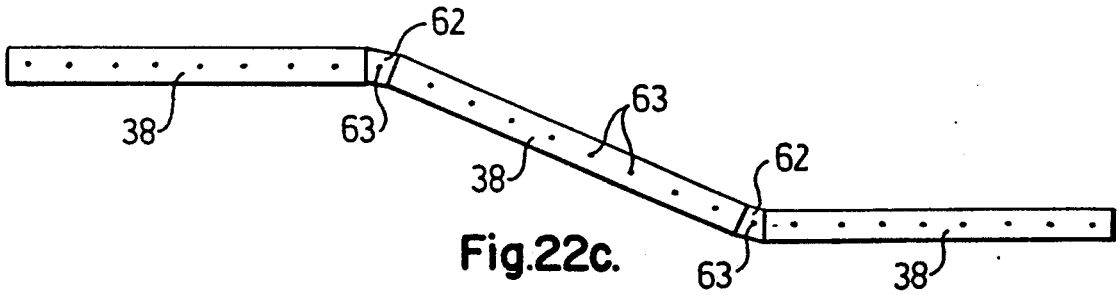
Figure 22D:
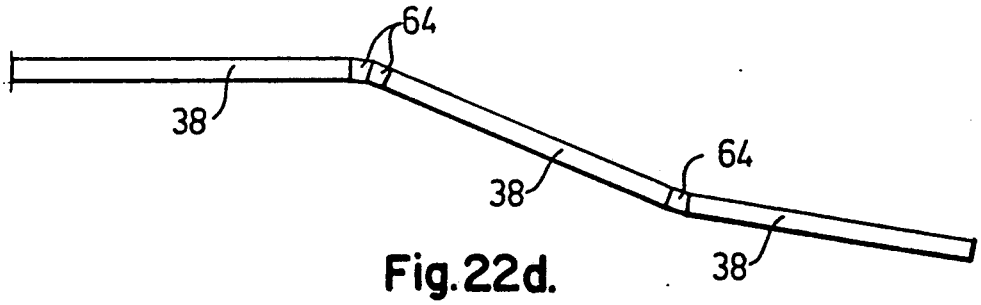

Since the teeth or pins of these joining elements 64 extend perpendicularly to the drawing plane in FIG. 22*d* there is no risk for jamming and accordingly there are neither any end clearances required.

Of the above types of joining elements 62 and 64, respectively, two types each are required, viz. for the joining elements 62 rightwardly and leftwardly directed design, respectively, and for the joining elements 64 upwardly and downwardly directed designs, respectively. The reason for this is that these joining elements as well the guide sections 38 shall include conduit sections for air and water to the mining equipment.

If not otherwise state, the components included in the mining equipment, which have not been described in more detail, can be of conventional kind. Thus, guide sections, drive means for the transport lift cage, drill rigs, etcetera, be of a conventional design, well known to the man of the art.

I claim:

1. A method for mining a narrow ore body in a mine having a mining chamber comprising the steps of:

forming a raise which substantially follows the narrow ore body and is in communication with the chamber;

providing a lift cage movable along the raise, the cage including a guide and mining equipment movably attached to the guide from which mining operations within the chamber can be carried out;

suspending a plurality of guide rail sections from a roof of the chamber so that the guide of the cage can be aligned with the guide rail sections suspended from the chamber roof by appropriately positioning the cage in the raise to permit movement of the mining equipment from the guide to the guide rail sections; and moving the mining equipment along the guide and the guide rail sections;

whereby ore can be mined with the working equipment as the equipment is moved along the chamber roof.

2. A method according to claim 1 including the steps of suspending a start guide from the chamber roof immediately adjacent the raise so that the mining equipment moves from the guide to the start guide, and preventing movement of the working equipment from the start guide to the guide when they are not in alignment.

3. A method according to claim 2 including the steps of providing the guide rail sections and the start guide with first conduits for flowing air and with second conduits for flowing water, fluidly connecting the first and second conduits, and flowing air and water through the first and second conduits, respectively, for use in the mining operation.

4. A method according to claim 1 wherein the step of suspending the guide rail sections comprises the steps of arranging the height and lateral extent of the guide rail sections so that they generally follow the contour of the ore body to be mined and bridge any faults that may be present.

5. A method according to claim 1 wherein the raise is at one end of the chamber; and including the step of forming auxiliary raise at another, opposite end of the chamber which generally follows the inclination of the ore body at the other chamber end.

6. A method according to claim 1 wherein the raise is intermediate ends of the chamber, and including the step of forming first and second auxiliary raises at respective ends of the chamber.

7. Apparatus for mining a narrow ore body in a mine having a mining chamber and a raise in communication with the chamber, the apparatus comprising:

a lift cage mounted within the raise for movement along the raise, the lift cage including a guide and mine working equipment suspended from and movable along the guide;

a plurality of guide rail sections suspended from a roof of the chamber so that the guide of the cage can be aligned with the guide rail sections by appropriately positioning the cage in the raise; and means for connecting the guide to the guide rail sections when they are in mutual alignment to permit movement of the cage along the guide and the guide rail sections, whereby ore can be mined with the working equipment as the cage and the equipment are moved along the chamber roof.

8. An apparatus according to claim 7 wherein the lift cage further comprises a means for adjusting the transport guide in transverse and longitudinal directions.

9. An apparatus according to claim 7 further comprising a means for pivotally suspending the mining equipment from the guide rail sections.

10. An apparatus according to claim 7 further comprising a means for pivotally suspending at least on of the guide rail sections from the roof of the mining chamber.

11. An apparatus according to claim 7 wherein the working apparatus comprises a working deck, the working deck being shiftable between a drawn and protruding position.

12. An apparatus according to claim 7 wherein the guide rail sections include a start guide located immediately adjacent the raise and means for preventing the mining equipment from moving past the start guide toward the raise when the start guide and the guide are not in mutual alignment.

13. An apparatus according to claim 12 wherein the guide rail sections and start guide comprise air conduits and water conduits, and wherein the start guide further comprises means for connecting the air conduits and water conduits, respectively, for use in the mining operation.

14. An apparatus according to claim 7 further comprising relatively short joining members which are nonparallel to the guide rail sections for joining guide rail sections such that the guide rail sections follow irregular portions of the ore body.

* * * * *